US005121671A

United States Patent [19]

Coburn

[11] Patent Number: 5,121,671

[45] **Date of Patent: * Jun. 16, 1992**

[54] BULLET TRAP

[75] Inventor: Ronald Coburn, Westfield, Mass.

[73] Assignee: Passive Bullet Traps Limited, Douglas, Isle of Man

[ * ] Notice: The portion of the term of this patent subsequent to Dec. 10, 2008 has been disclaimed.

[21] Appl. No.: 760,714

[22] Filed: Sep. 16, 1991

Related U.S. Application Data

[63] Continuation of Ser. No. 627,705, Dec. 14, 1990, Pat. No. 5,070,763.

[51] Int. Cl.[5] ..... F41J 1/14

[52] U.S. Cl. ..... 89/36.02; 273/410

[58] Field of Search ..... 273/394, 410, 404; 89/36.02

[56] References Cited

U.S. PATENT DOCUMENTS

| | | | |
|---|---|---|---|
| 385,546 | 7/1988 | Decambus | 273/404 |
| 694,581 | 3/1902 | Reichlin | 273/404 |
| 840,610 | 1/1907 | Easdale | 273/404 |
| 2,013,133 | 9/1935 | Caswell | 273/410 |
| 2,772,092 | 11/1956 | Nikoden | 273/410 |
| 3,737,165 | 6/1973 | Pencyla | 273/410 |
| 3,981,186 | 2/1889 | Rehfuss | 273/404 |
| 4,126,311 | 11/1978 | Wagoner | 273/410 |
| 4,512,585 | 4/1985 | Baravaglio | 273/410 |
| 4,728,109 | 3/1988 | Simonetti | 273/410 |
| 4,821,620 | 4/1989 | Cartee et al. | 89/36.02 |

FOREIGN PATENT DOCUMENTS

| | | | |
|---|---|---|---|
| 500781 | 6/1930 | Fed. Rep. of Germany | 273/410 |
| 6353 | of 1908 | United Kingdom | 273/410 |

*Primary Examiner*—David H. Brown
*Attorney, Agent, or Firm*—Norbert P. Holler

[57] ABSTRACT

A bullet trap for a horizontally fired bullet includes a passageway bounded by upper and lower flat plates which may be inclined to the horizontal at an angle of between 0° and 7°. The passageway has an entrance opening and a shallow exit opening or throat, and a generally spiral-walled spent bullet energy-dissipating chamber having a horizontal axis communicates substantially tangentially with the passageway through the throat. A white water lubricant is sprayed against the circumferential boundary wall of the chamber and engulfs any lead dust, spent bullets, and other particles, the lubricant then flowing down through the throat into the passageway and along the lower plate into a collecting vessel, flushing the lead dust, spent bullets, etc. into the vessel without possibility of escape into the environment. The self-cleaned lubricant is continuously recirculated from the collecting vessel to the spray head in the chamber.

9 Claims, 2 Drawing Sheets

BULLET TRAP

CROSS-REFERENCE TO RELATED APPLICATION

This application is a continuation of prior copending application Ser. No. 627,705 filed Dec. 14, 1990, now U.S. Pat. No. 5,070,763 issued Dec. 10, 1991. To the extent necessary for an understanding of the invention, the entire disclosure of the prior application is incorporated herein by this reference.

This invention relates to bullet traps, i.e., devices used to catch and stop bullets fired from rifles, shotguns, handguns, and the like in a firearm testing facility or a commercial firing range, and in particular to bullet traps which are equipped with a liquid circulating system for capturing lead dust and other particles in the traps and for flushing the same from the traps directly into a collecting vessel.

BACKGROUND OF THE INVENTION

Bullet traps per se are well known devices which have been used for many years by firearm manufacturers and users (the latter including firing ranges operated by military installations, police departments, rifle and pistol clubs, and the like) who are faced either with the need to proof, function fire and target firearms such as handguns, rifles and shotguns or with the task of simply collecting spent bullets fired on the range. In this context, "proof" means test firing a firearm at a higher load of ammunition, usually 40% greater, than the regular load specified for the barrel of that firearm; "function fire" means test firing the firearm through its full cycle of functions; and "target" means test firing the firearm for accuracy. The objectives of such devices have been to provide means located at a relatively short distance from the shooter to catch the lead or other types of bullets (jacketed or unjacketed) and prevent either the ricochet of a whole bullet or a large fragment thereof or the backsplattering of numerous small metal particles, which could return with enough energy to cause injury to the shooter or innocent bystanders, and to collect the waste lead, brass and jacket material. The known types of bullets traps have run the gamut from wood boards to sand-filled boxes to metallic funnel and deceleration chamber combinations.

Merely by way of example, a known sand-type bullet trap consists of a quantity of sand in a hardwood box set against a concrete backstop or wall. However, a bullet trap of this class has a number of drawbacks and disadvantages, both in terms of its structural and functional characteristics and in terms of the expenses associated with it. The material requirements for the box are, for example, 640 linear feet per year of 2"×8"×10' hardwood, and 45 cubicyards per year of sand. Annual maintenance requires 8 man-hours per week for 50 weeks. Disposal of such a sand/wood trap and accumulated waste requires handling a load of about 15 tons per year, including transportation to a landfill. Assuming 5–6 loads per year, annual expenditures at current costs (including labor) come to about $30,000 plus the cost of the sand and hardwood, for an aggregate total of about $40,000. Moreover, under current environmental laws, lead has been banned from landfills unless it has first been treated to meet new disposal standards, and the separation of lead from the sand and the detoxification treatment thereof (e.g., a thermal oxidation, which has been proposed for this purpose) can easily double or triple the disposal costs.

On the other hand, the mechanical bullet traps of the funnel and deceleration chamber type, which came onto the market about a century or so ago, were specifically designed to deal with some of the problems that were inherent to the sand-filled box types of traps. Some representative relatively simple bullet trap constructions of the funnel and chamber type are disclosed in U.S. Pat. No. 385,546 (Decumbus 1888); U.S. Pat. No. 694,581 (Reichlin 1902); U.S. Pat. No. 840,610 (Easdale 1907); U.S. Pat. No. 2,013,133 (Caswell 1935); and U.S. Pat. No. 4,126,311 (Wagoner 1978). Somewhat more sophisticated bullet trap constructions are disclosed in U.S. Pat. No. 2,772,092 (Nikoden 1956); U.S. Pat. No. 3,737,165 (Pencyla 1973; U.S. Pat. No. 4,512,585 (Baravaglio 1985); and U.S. Pat. No. 4,821,620 (Cartee et al. 1989).

Of the first-mentioned set of these bullet traps, to the best of my knowledge none are in current commercial use, primarily because they were not designed for and were incapable of withstanding the impacts of high power steel-jacketed ammunition, but also because they tended to deteriorate rather rapidly even under the impacts of relatively low power ammunition. In essence, this was due not only to the fact that the steel or like metal of which the impact plates defining the funnel and the initial contact region of the deceleration chamber were made was generally of a relatively low grade in terms of its composition (carbon content, etc.) and strength, but also to the fact that the impact plates were generally arranged at relatively high angles (30°–60°) to the bullet flight path. Bullets coming into contact with such impact plates at high momentum and at relatively large angles invariably ricochet from one of the funnel impact plates to the other at relatively high angles of incidence and ultimately impact at a high angle against the interior surface of the circumferential boundary wall of the deceleration chamber and bounce along the same from point to point. This has not only resulted in a shattering and fragmentation of the bullets but also in a relatively high rate of deterioration of the impact plates and the deceleration chamber wall and frequent occurrences of penetration thereof by the bullets or fragments thereof. The escape of a bullet or its fragments from confinement in the chamber, of course, further entails the danger of injury and even death to the shooter or an innocent bystander and also, where the-bullets are made of lead, contributes to lead pollution of the environment.

Even the more recent ones of the patented bullet traps, however, some of which, to the best of my knowledge, may currently be in use, have been beset by numerous drawbacks, including high original equipment manufacturing, installation and maintenance costs, the need for frequent replacement of baffle or impact plates which are damaged through scoring, erosion and penetration by bullet impacts, the need for minimizing lead build-up and for controlling the problem of lead dust (airborne lead dust must be eliminated using sophisticated vacuum systems), and the need for dealing with hazardous waste (handling, collection/separation, transportation and disposal). Moreover, such bullet traps are generally not multi-functional, i.e., they cannot be used to proof, function fire and target firearms in one system because their impact plates would be demolished by the high load ammunition used in proofing. Also, these traps are usually limited by their design for use with either handguns or high powered rifles but not both.

BRIEF DESCRIPTION OF THE INVENTION

It is an object of the present invention to provide a novel and improved bullet trap by means of which one of the principal drawbacks and disadvantages of the known bullet traps, namely, their inability to limit the generation of lead dust and to prevent environmental pollution by such lead dust, can be efficaciously avoided.

It is another object of the present invention to provide a bullet trap which incorporates a combination lubricating and flushing system designed to apply to at least those interior boundary surfaces of the trap which are most exposed to contact by the bullets fired into the trap, a quanity of a liquid lubricant which is sufficient for minimizing friction and metal to metal contact between the bullets and the boundary wall surfaces of the trap for reducing scoring and erosion of those surfaces as well as the generation of lead dust, and for the purpose of engulfing and flushing out of the trap to a collecting vessel any lead dust that may be formed during the passage of the bullets through the trap as well as any accompanying spent bullets and bullet fragments, jackets and casings.

Generally speaking, the objectives of the present invention are attained by a bullet trap for catching and deenergizing a bullet fired along a substantially horizontal path of flight from a firearm, which trap (like many of the known traps) has a first pair of spaced flat plates located on opposite sides of the path of flight of the bullet and a second pair of spaced flat plates arranged transverse to the first plates on opposite sides of the bullet flight path, with the two pairs of plates defining the respective sides of a passageway having at its front end an entrance opening and at its rear end an exit opening or throat through which the bullet can pass, and a spent bullet deceleration and energy-dissipating chamber the circumferential boundary wall of which is of generally spiral configuration and the opposite end walls of which are constituted by portions of the respective second plates, with the passageway communicating with the chamber substantially tangentially of the latter through the throat.

In a trap of this general class, the basic improvement provided by the present invention comprises the provision of a spray nozzle arrangement in the deceleration chamber for directing a spray of a lubricating fluid, preferably a white water lubricant of a commercially available type consisting of, for example, 4 parts water and 1 part mineral oil, against the interior surface of the circumferential boundary wall of the deceleration chamber. Preferably, the spray is directed against the initial part of the wall of the chamber which is located just rearwardly of the throat through which the bullets enter the chamber from the passageway, and generally somewhere in the zone between the three o'clock and five o'clock positions, for example, at the three-to-four o'clock position. The lubricating fluid thereby flows downwardly over that portion of the chamber wall, enters the passageway through the throat thereof, and then flows along ably adjacent the front end thereof, ultimately dropping down into a collecting vessel, for example, a 55 gallon steel drum, located below a suitable opening provided in the front end region of the lower first plate.

The lubricating fluid thus serves multiple functions. On the one hand, it lubricates both the lower first plate of the passageway structure and the initial part of the deceleration chamber boundary wall and at the same time applies a coating of lubricant to the bullets fired into the trap and coming into contact with the lower first plate, thereby minimizing the metal to metal contact between the bullets and the metal surfaces along which they move, with the result that scoring and erosion of those surfaces as well as the generation of lead dust, if the bullets are made of lead, are reduced as far as possible. (Because the metal to metal contact between the bullets and the trap surfaces can never be completely eliminated, even with a lubricant coating the surfaces, the generation of lead dust can also not be completely eliminated.) On the other hand, the liquid lubricating fluid serves as a flushing agent through the intermediary of which shells, casings, spent bullets, any lead dust that is generated, and even any fragments of a larger size that might split off from the bullets, are engulfed in the liquid and are flushed thereby along the lower first plate of the passageway and enter the collecting vessel together with the liquid. Escape of lead dust (atomized lead) into the environment and potential health hazards which that would pose are thus effectively avoided.

In accordance with the present invention, the spray nozzle system in the bullet deceleration chamber, which may be in the form of a conduit extending generally parallel to the horizontal axis of the chamber along the full length of the latter and having a plurality of holes or orifices provided therein along its entire length, is interconnected with the collecting vessel by suitable piping, and a pump is incorporated in the piping, so that the lubricating fluid can be recirculated from the collecting vessel to the spray nozzle conduit. Preferably, the piping is connected to the collecting vessel in an upper region thereof but in any event at a substantial elevation above the bottom of the vessel. This ensures that the lubricating fluid which is extracted from the collecting vessel by the pump for recirculation to the spray nozzles is free and clear of solids accumulated in the collecting vessel, because the solids, being considerably heavier than the liquid, will tend immediately upon their entry into the collecting vessel to sink to and settle on the bottom thereof. The lubricating fluid thus is automatically self-cleaned, preventing recirculation of lead dust or any other solids to the deceleration chamber.

In accordance with a further feature of the invention, the collecting vessel is also provided across its entire expanse near the top thereof with a sieve or strainer member. Preferably, the sizes of the openings of the strainer member are such that they will permit any lead dust entrained in the lubricating fluid to pass through the strainer member but will not permit larger metal particles or shells or casings to pass through. Thus, lead dust will accumulate on the bottom of the collecting vessel while larger objects will be retained on the strainer member.

It will be further understood, therefore, that, since the lubricating fluid moves through an essentially closed and self-contained system, it basically requires nothing more by way of maintenance than a periodic replacement of any water that may have evaporated over time. In this connection, the lubricant circulation system of the trap provides the additional advantage, previously noted herein, that it enables dispersion of lead dust into the environment to be inhibited. Thus, when a bullet is fired into the trap, any lead dust generated in the course of the movement of the bullet along the surfaces of the initially encountered impact plate and the subsequently encountered circumferential wall of the deceleration chamber is inevitably, and without any possibility of escape from the system, engulfed by and entrapped in the liquid lubricant fluid sprayed out of the spray nozzles and continuously flowing downwardly over the chamber wall and from there on over the lower plate of the passageway. As a consequence, the lead dust is flushed by the liquid into the collecting vessel, where it settles out of the liquid and accumulates on the bottom of the vessel.

Accordingly, since liquid from the passageway continuously enters the collecting vessel at substantially the same rate as it is extracted therefrom by the circulating pump, the accumulated mass of lead dust in the bottom of the collecting vessel always remains submerged in the portion of the liquid located in the vessel and hence cannot be dispersed from the vessel into the surrounding atmosphere. On the other hand, when enough lead dust has accumulated in the collecting vessel to make it appropriate to do something with it, for example, to recycle it for further use in making bullets, the circulatory piping is disconnected from the vessel and the latter can then be simply removed as is, i.e., with all its contents, and replaced by a different one while the extraction of the accumulated lead from the liquid is effected under suitable anti-pollution precautionary measures. The so-achieved salvaging of the heretofore normally wasted lead dust for reuse thus provides an economic benefit as well, which has not been achievable with any of the known bullet traps.

BRIEF DESCRIPTION OF THE DRAWINGS

The foregoing and other objects, characteristics and advantages of the present invention will be more clearly understood from the following detailed description thereof when read in conjunction with the accompanying drawings, in which.

DETAILED DESCRIPTION OF THE INVENTION

Figure 1:
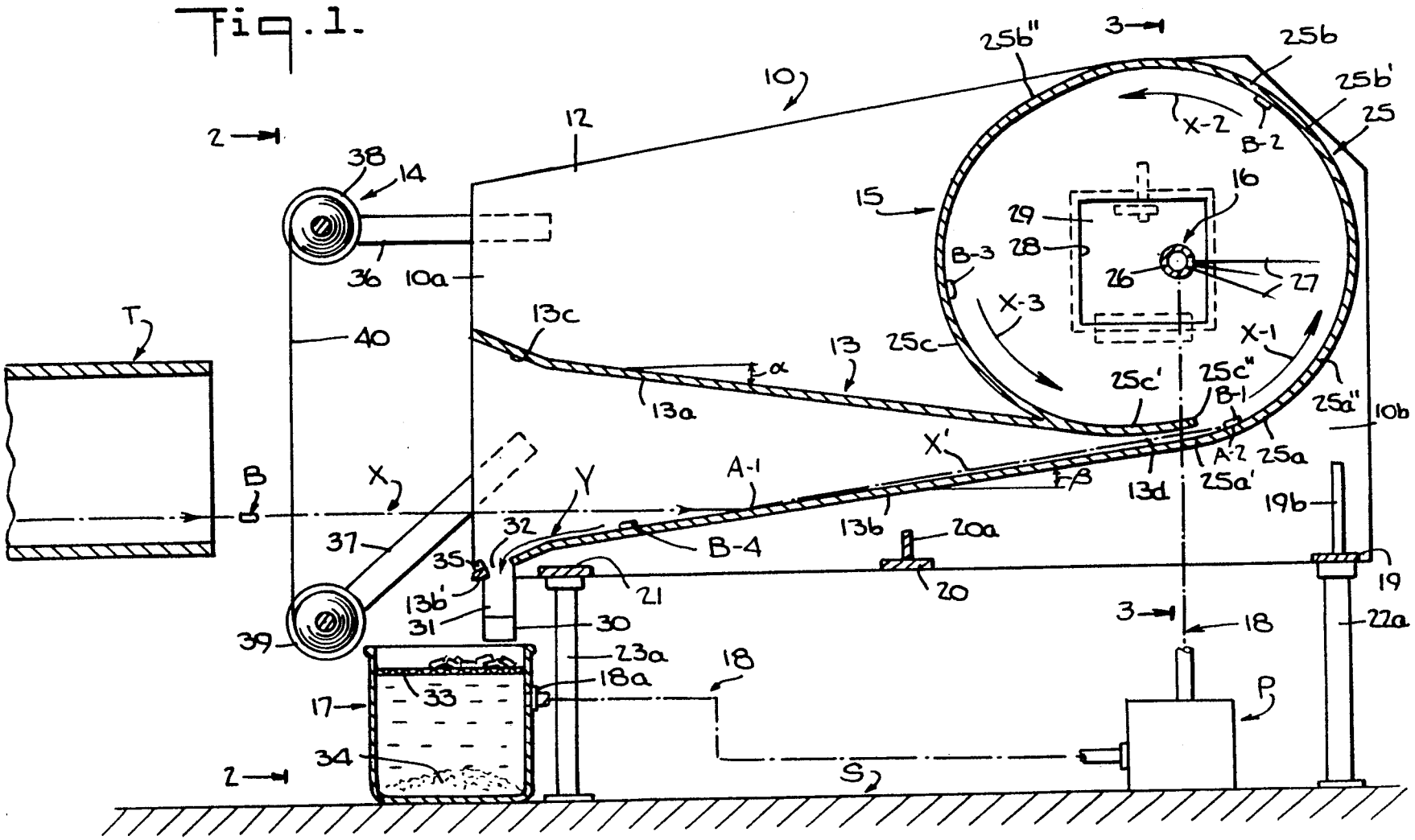
FIG. 1 is a longitudinal vertical section through a bullet trap of the type disclosed and claimed in the aforesaid prior application Ser. No. 627,705 and shows the same as equipped with a lubricating/flushing system according to the present invention.

Referring now to the drawings in greater detail, a bullet trap 10 is shown as including, between a pair of spaced elongated vertical side walls 11 and 12, a passageway structure 13 having upper and lower walls **13*a* and 13*b* and into the front end entrance opening 13*c* of which a bullet B can be fired from a firearm (not shown) supported on a suitable test-firing stand (not shown) but including an aiming tube T the inner diameter of which is about 3 inches less than the height of the entrance opening 13*c*. The trap further includes at its front end a target positioning means 14 and at its rear end a generally spirally configured spent bullet deceleration and energy-dissipating chamber 15 the interior of which communicates substantially tangentially thereof with the interior of the passageway structure 13 through a shallow exit opening or throat 13*d* of the latter. Located in the chamber 15 is a suitable spray nozzle means 16 for spraying a liquid lubricant onto a selected region of the interior wall surface of the chamber. A collecting vessel 17 for receiving liquid lubricant and solids discharged from the chamber and passageway structure is arranged under the lower wall 13*b* of the passageway structure at a suitable discharge location (e.g., adjacent the front end) thereof, and a piping arrangement 18 incorporating a pump P is provided between the collecting vessel 17 and the spray nozzle means 16** for feeding liquid lubricant from the collecting vessel to the spray nozzle means.

The side walls 11 and 12 of the trap 10 are constituted of preferably metallic plates (previously referred to herein as the second plates) of, for example, 3/16" thick mild steel sheet and are welded at a plurality of longitudinally spaced locations (three are illustrated and have been found to be sufficient) to the opposite ends of respective horizontal cross beams 19, 20 and 21. Of these, the beams 19 and 21 are welded to and supported by respective pairs of vertical legs 22, **22*a* and 23, 23*a* adapted to stand on a suitable supporting surface S, for example, the ground or a floor of a room or basement of a building. Additional rigidity is imparted to the side wall structure of the trap by a pair of right triangular vertical stiffening plates 19*a*, 19*b* which are welded to the cross beam 19 and the proximate regions of the side wall plates 11 and 12, and by a rectangular vertical stiffening plate 20*a* which is welded along one longitudinal edge thereof to the cross beam 20 and at its opposite end edges to the proximate regions of the side wall plates 11 and 12**.

The upper and lower walls **13*a* and 13*b* of the passageway structure 13 of the trap are constituted of preferably metallic plates (previously referred to herein as the first plates) of, for example, $\frac{3}{8}$" to $\frac{3}{4}$" thick high tensile steel sheet and are welded at the respective opposite side edges thereof to the inwardly directed faces of the side wall-forming plates 11 and 12. The plates 13*a* and 13*b* are located above and below, respectively, the horizontal path of flight X of the bullet B. In the illustrated trap, the plates 13*a* and 13*b* are shown as being oppositely inclined relative to the horizontal at respective angles $\alpha$ and $\beta$ and as converging toward one another from the front end region 10*a* of the trap toward the rear end region 10*b* thereof, i.e., in the direction of flight of the bullet. The plates 13*a* and 13*b* thereby define a generally funnel-shaped passageway structure having a relatively wide entrance opening 13*c* at the front end and a relatively shallow throat or exit opening 13*d* at its rear end. The angles of inclination $\alpha$ and $\beta$ of the plates 13*a* and 13*b*** lie between 0° and about 7° to the horizontal and preferably (but not necessarily) are equal to each other.

The deceleration chamber 15 of the trap 10, which has a horizontal axis, is located generally rearwardly of the passageway structure 13 and is defined between respective portions of the side wall forming plates 11 and 12 in the rear end region **10*b* of the trap and a circumferential boundary wall 25 welded at its opposite side edges to the plates 11 and 12. The wall 25 in the illustrated embodiment of the trap is an extension of (i.e., of one piece with) the lower plate 13*b*** of the passageway structure and has a generally spiral configuration.

In essence, the chamber wall 25 may be considered as having three distinct parts: (i) an initial part 25*a* which extends from the throat 13*d* generally rearwardly of the passageway structure, first at an angle of inclination to the horizontal substantially the same as that of the lower plate 13*b*, as shown at 25*a'*, and then arcuately upwardly relative thereto, as shown at 25*a''*; (ii) a middle part 25*b* which extends arcuately from the initial part 25*a* generally frontwardly of the passageway structure, first upwardly, as shown at 25*b'*, and then downwardly, as shown at 25*b* ''; and (iii) a terminal part 25*c* which extends arcuately from the middle part 25*b* downwardly and generally rearwardly of the passageway structure into substantially coplanar relation, as shown at 25*c'*, with the upper plate 13*a* of the passageway structure and has an end edge 25*c''* overlying the region 25*a'* of the initial part of the circumferential boundary wall 25 contiguous to the lower plate 13*b* but spaced from that region by about 1.5 to about 3 inches, i.e., at least the same as the height of the throat 13*d* of the passageway structure 13.

Of especial significance, in this connection, is the fact that no part of the circumferential boundary wall 25 of the deceleration chamber 15 has a radius of curvature of less than about 28 inches. This minimum magnitude of the radius of curvature has been empirically determined as being appropriate for the circumferential wall of the deceleration chamber so as to enable the same to function as a deflection plate for relatively gently turning the bullet B out of its pre-contact straight ahead trajectory to a curving path actually reversing its initial direction of flight, as indicated by the arrows X-1, X-2 and X-3 in FIG. 1. However, the radii of curvature of some regions of the wall 25 may be greater than 28 inches; for example, in the illustrated trap embodying the present invention, the radius of curvature of the middle part 25*b* of the wall 25 is preferably about 30 inches while the radius of curvature of the terminal part 25*c* is again about 28 inches.

In this construction, it should be emphasized, the initial part of the deceleration chamber wall is, for all practical purposes, the most important region thereof because it serves to overcome the bullet's resistance to a change in its direction of flight and out of its original straight ahead trajectory. To ensure that this occurs without either a fragmentation of the bullet or a destructive scoring or penetration of the chamber wall, the initial part of the latter has a radius of curvature of not less than about 28 inches. This minimum value of the radius of curvature has been empirically determined to be appropriate to keep the maximum amount of the side of the bullet presented to the chamber wall during its travel along the initial part of the latter. In this way, the shock of the bullet is distributed more evenly along the wall and over a larger surface area thereof, and tumbling of the bullet because of its nose digging into the chamber wall (which would occur were the radius of curvature of the wall smaller than 28 inches) is prevented. It will be understood, therefore, that since it is highly desirable to achieve the same effect along the entire circumferential chamber wall, the same is designed so as to have at no part thereof a radius of curvature smaller than 28 inches.

Figure 3:
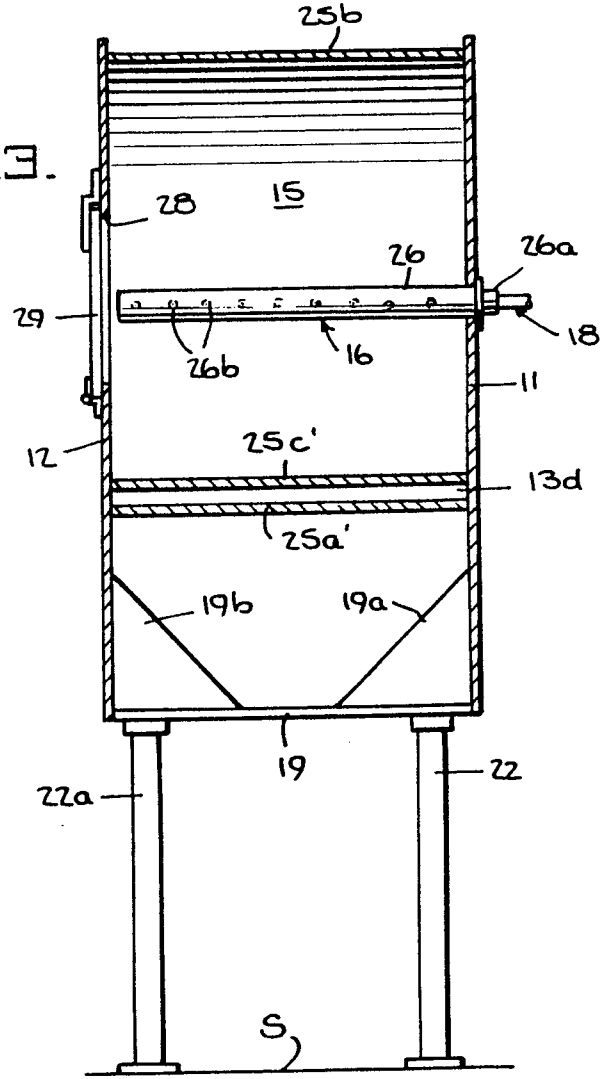
FIG. 3 is a sectional view taken along the line 3—3 in FIG. 1.

The spray nozzle means 16 according to the present invention (FIGS. 1 and 3) for directing sprays or streams 27 of white water lubricant against the interior surface of the circumferential boundary wall 25 of the deceleration chamber 15 comprises a conduit or pipe 26 securely mounted at one end region 26*a* thereof in the side wall 11 and extending across almost the entire length of the chamber substantially parallel to the horizontal axis of the same. An opening 28 is provided in the side wall 12 of the trap generally at the level of the conduit 26 to permit access to the latter and to the interior of the chamber 15 for cleaning, repairs, etc., the opening being normally closed and sealed by a door or cover plate 29. The conduit 26 is provided with a series of orifices or nozzles 26*b* spaced from one another longitudinally of the conduit and facing toward the initial part 25*a* of the circumferential boundary wall of the chamber. While the exact positioning of the nozzles is not critical, it is preferred that they be arranged to direct the streams 27 of the liquid lubricant against the initial wall part 25*a* somewhere in the zone between the 3-o'clock and 5-o'clock positions, for example, at the zone between the 3-o'clock and 4-o'clock positions as indicated diagrammatically in FIG. 1. The internal diameter of the pipe or conduit 26 and the diameters of the nozzles are likewise not critical as long as they enable the liquid lubricant to be delivered in the required volume and at the desired rate of flow; merely by way of example, a pipe having a 1-inch interior diameter and a plurality of 5/16-inch diameter holes or orifices therein has been found satisfactory.

The liquid lubricant is initially contained in the collecting vessel 17 and is fed therefrom to the conduit 26 via the piping 18, which is connected to the vessel 17 in its upper region by means of a fitting 18*a*, and the pump P incorporated in the piping. The collecting vessel, e.g., a 55-gallon steel drum, is located below the front end region 13*b'* of the lower plate 13*b* of the passageway structure 13, under a discharge chute 30 which communicates with the bottom outlet opening 31*a* (FIG. 2) of a trough 31 extending across the entire width of the front end region 10*a* of the trap, the trough being welded at its opposite ends to the side walls 11 and 12 of the trap and at its upper edges to the underside of the plate 13*b* and thus having its upper intake opening 31*b* located directly below a 2-inch or so wide slot-shaped opening 32 provided in the plate 13*b*. A removable sieve or strainer member 33 is located in the upper region of the collecting vessel, preferably somewhat below its top rim, the openings of the strainer member being large enough to permit passage of liquid and of lead dust therethrough but small enough to cause bullets, large bullet fragments, shells and casings to be retained thereon.

Figure 2:
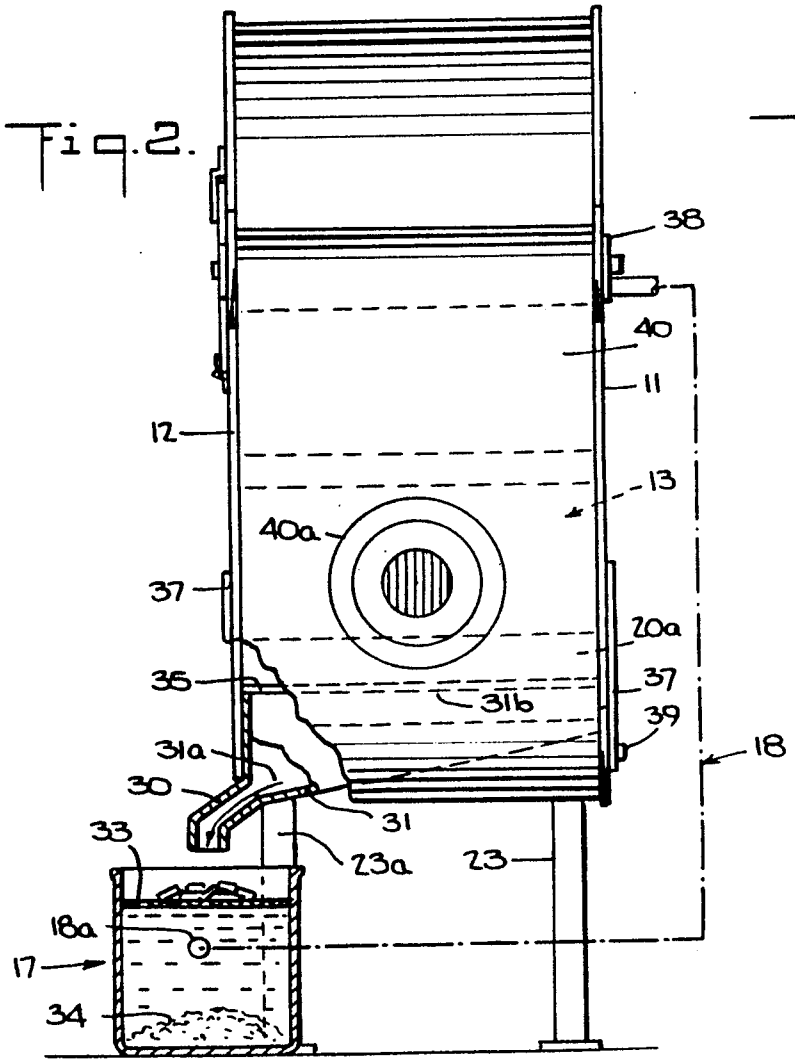
FIG. 2 is a front end elevational view of the trap with some parts being broken away and illustrated in section to show details, the view being taken along the line 2—2 in FIG. 1.

In the illustrated embodiment of the trap, the target positioning means 14 is shown as including a pair of upper arms 36 and a pair of lower arms 37 which are secured, by welding or by means of rivets or bolts (not shown), to the outer surfaces of the side wall plates 11 and 12. The two pairs of arms are provided with journals or bearing means (not shown) for rotatably supporting the opposite ends of respective rolls 38 and 39 between which extends a band 40 of sheet material (e.g., paper). The band is wound on the rolls, with its opposite ends connected to the same, and is provided on that surface thereof which in the region between the rolls faces away from the trap and toward the shooter, with a multiplicity of target images 40*a* (only one is shown in FIG. 2). One of the rolls 38 and 39 is provided with drive means (not shown) for rotating it so as to enable the band to be drawn from the idler roll and wound up on the driven roll for the purpose of shifting a fresh target image into position in front of the entrance opening 13c of the passageway structure 13. The drive means for rotating the driven roll and advancing the band may be manually operatable, e.g., a crank handle connected to the roll axle, or remotely operatable, e.g., an electric motor connected (with or without suitable gearing) to the roll axle and adapted to be actuated by the shooter from his or her position.

The change in its flight path X which the bullet will undergo after impacting against the lower plate 13b of the passageway structure 13 is diagrammatically illustrated in FIG. 1. Assuming that the initial flight path X is substantially horizontal, when the bullet impacts at some point A-1 against the plate 13b, it is deflected away therefrom, as indicated by the dot-dash line X', at a very small angle of about 1° or so to the lower plate 13b. Thus, in this example, if $\beta$ is 7°, the angle of inclination of the path X' to the horizontal is only about 8°, so that, as shown, the bullet never contacts the upper plate 13a and instead passes directly through the throat 13d of the passageway. It then comes into contact at point A-2 with the gently upwardly sloping region 25a'' of the initial part 25a of the circumferential boundary wall 25 of the deceleration chamber 15. Both these impacts are at such relatively low angles that the risk of damage or destruction of the plates 13a/13b and the initial part of the chamber wall 25 is effectively minimized. The same result would, of course, be achieved if the bullet were to contact the upper plate 13a, except that the path X' would then angle down from the plate 13a.

As mentioned in the aforesaid prior application, the upper and lower plates 13a and 13b of the passageway structure 13 are inclined at respective angles of about 7° to the horizontal. It should be understood, however, as there pointed out, that the angle of inclination of either or both of the plates 13a and 13b to the horizontal may be smaller than 7°. For example, an orientation of the upper and lower plates of the passageway structure 13 at angles of inclination $\alpha$ and $\beta$ as small as about 1° or 2° is even more effective in avoiding a shattering of the bullets upon impact than an orientation at a 7° angle. Actually, an angle of inclination of 0° (at which the plates 13a and 13b, strictly speaking, are not inclined but rather are parallel to the horizontal and each other) is still better from the standpoint of avoiding shattering of the bullets, because of the greater possibility that a properly aimed bullet fired into the passageway structure will travel straight through the latter and into the deceleration chamber without contacting either of the upper and lower plates 13a and 13b.

The utilization of such low-angle orientations of the upper and lower impact or deflection plates of the passageway structure is, nonetheless, counterindicated by practical considerations. To begin with, it must be kept in mind that the desired height of the throat or exit opening 13d of the passageway structure 13 is about 1.5 inches to about 3 inches at most, and preferably not more than about 2 inches. As a consequence, an orientation of the plates 13a and 13b at angles of inclination of 2° or less would entail providing an entrance opening for the passageway structure as small or almost as small as the exit opening. Thus, assuming the length of the passageway to be 10 feet from the entrance opening 13c to the exit opening 13d thereof, positioning the upper and lower passageway plates 13a and 13b at an angle of inclination of 1° to the horizontal would provide an entrance opening of a height of about 4 inches, which would leave very little margin for error in the aiming of the firearm. Positioning the muzzle of the firearm being fired almost directly adjacent or even in such a small entrance opening 13c of the passageway structure would, of course, minimize and perhaps even totally eliminate the risk of the bullet missing that opening. However, even though such a positioning of the firearm might well be tolerable for purposes of proofing or function firing of the firearm, it would not be an acceptable practice for the purpose of target testing, which requires that the muzzle of the firearm be located a substantial distance, e.g., at least about 75 feet, from the bullet trap to enable the bullet to stabilize as it moves in its path of flight before it reaches the location of the target in front of the trap.

It is these considerations, therefore, Which make it preferable to orient the upper and lower plates 13a and 13b of the passageway structure at angles of inclination of 7° to the horizontal. At a 7° angle of inclination of the two plates of a 10-foot long passageway structure 13, the entrance opening is approximately 29–30 inches in height (in a 12-foot long structure, the height of the entrance opening is 35–36 inches), which for all practical purposes eliminates the risk of the bullet missing the passageway altogether even when the firearm is being targeted.

It will be apparent from the foregoing that the term "angle of inclination" as used in this application is intended to designate, and should be interpretered as designating, any orientation of the plates 13a and 13b at an angle within the range of 0° to 7° to the horizontal.

It will be understood, therefore, that when a bullet B is fired into the trap and impacts against one of the passageway boundary plates, for example, the lower plate 13b of the passageway structure 13, it will lose a small part of its energy by virtue of that first contact. Thereafter, the bullet continues substantially unimpeded into the deceleration chamber. Here, it should be noted that although the presence of the lubricant in the passageway and the deceleration chamber does serve to reduce to a great degree the frictional metal to metal contact between the bullet and the plate or plates it contacts, it does not eliminate frictional effects altogether. Accordingly, where the bullet is made of lead (as probably 90% of all bullets are), there will be a certain amount of lead dust generated which, were it to escape into the atmosphere, would pose a major health and environmental hazard. However, because that lead dust is simultaneously with its formation engulfed in the flowing liquid lubricant and entrained thereby to move therewith toward the collecting vessel 17, the lead dust cannot escape. Moreover, as the lubricant flows into the vessel 17, the lead dust, being considerably heavier than the liquid, almost immediately settles to the bottom of the vessel and accumulates there, as indicated at 34.

This action, as can be seen, has two direct and highly advantageous consequences apart from the ecological benefit mentioned above. One is of operational significance, in that the quantity of liquid located in the vessel 17 above the accumulated lead dust 34 is effectively self-cleaned, and thus when the liquid is extracted from the upper region of the vessel and recirculated through the piping 18 and the pump P to the spray nozzle means 16, it does not contain any lead dust and clogging of the pump and the nozzles 26b is avoided. The other is of economic significance, in that the system provides an automatic conservation and salvaging of the lead dust as a raw material. Thus, when enough lead dust has accumulated in the collecting vessel to make it appropriate to remove it, the pump is deactivated, the fitting or valve cock 18*a*is closed, the piping is disconnected therefrom, and the vessel is covered and sealed, preferably after the strainer member and its accumulated debris have been removed, and is transported to a suitable location where, under appropriate environmental safeguards, the lead dust can be separated from the liquid remaining in the vessel and processed for reuse in manufacturing bullets.

Reverting now to the bullet entering the trap, the residual energy of the bullet, after it has passed through the throat or exit opening 13*d* of the passageway structure, is dissipated as the bullet circumnavigates the deceleration chamber 15. The spent bullet ultimately falls off the terminal part 25*c* of the chamber wall 25 and over the end edge 25*c*'' thereof onto the initial part 25*a* of the wall 25 contiguous to the lower plate 13*b* of the passageway structure 13. From there, the bullet rolls or slides through the throat 13*d* along the plate 13*b*, as indicated at B-4 and by the arrow Y in FIG. 1, toward the discharge region thereof, being assisted by the liquid lubricant which, after having been sprayed against the initial part 25*a* of the chamber wall, flows downwardly along the same and thence through the throat 13*d* and along the lower plate 13*b* of the passageway structure 13 toward the front of the trap. The liquid finally drops through the opening 32 into the trough 31 and thence into the collecting vessel 17. A transverse ridge or plate 35 is provided atop the end portion 13*b*' of the plate 13*b* at the downstream edge of the opening 32 to constitute a barrier for deflecting the liquid and the bullets, bullet fragments, shells and casing descending along the plate 13*b* into the opening 32 and inhibiting their passage over the plate end portion 13*b*'.

The white water lubricant thus will be seen to serve several functions. On the one hand, as previously mentioned, it lubricates the initial part 25*a* of the chamber wall and the lower wall 13*b* of the passageway structure directly, so that the otherwise frictional metal to metal contact between a bullet fired into the trap and those wall surfaces is minimized to inhibit as far as possible fragmentation of the bullet and the generation of lead dust. By virtue of its passage through the countercurrent flow of lubricant, of course, the bullet itself also becomes coated with the lubricant, which then minimizes the frictional metal to metal contact between the bullet and the parts 25*b* and 25*c* of the chamber wall against which the liquid lubricant is not directly sprayed by the spray nozzle means 26. On the other hand, as also mentioned previously herein, the lubricant serves as a flushing agent, to wet down and engulf any spent bullet, shell and casing located on the chamber wall part 25*a* and the plate 13*b* as well as any lead dust that may be generated by the passage of the bullet through the trap, and to effectively transport the same along the plate and into the collecting vessel. Still further, the lubricant adds a measure of soundproofing to the trap (it has been found that the noise level is as much as 10 db less in the presence of the liquid than in its absence) because the white water absorbs vibrations and harmonics resulting from the impacts of the bullets against and their movements along the plates 13*a*and 13*b* of the passageway structure and the circumferential boundary wall 25 of the deceleration chamber 15.

As described in the prior application, the space requirements for the trap are relatively minimal. Thus, in a representative construction, the length of the trap from its front end edge (exclusive of the target positioning means) to its rear end edge is approximately 10–12 feet, the height of the trap from its bottom edge (exclusive of the legs of the trap) to its top edge at the region of maximum height of the deceleration chamber is approximately 6–8 feet, and the width of the trap is about 3–4 feet. The height of the legs of the trap is about 2–3 feet but may be somewhat more or less than that. Furthermore, by virtue of the unique properties of the trap, the distance from the location of the muzzle of a firearm being tested to the entrance opening of the passageway structure, even when the test involves targeting a high-powered rifle or the like, need be no more than about 25–30 yards (75–90 feet) at most. As a consequence, the entire testing arrangement is relatively inexpensive to manufacture and can be located inside, for example, a room or basement of a factory building where it will be protected from the effects of high winds and bad weather conditions. The trap per se can be constructed so as to enable it to be readily moved from one location to another, whereby the need for a permanent installation is avoided. Still further, means affording access to the interior of the deceleration chamber are provided so as to permit cleaning, repair and/or replacement of the spray nozzle means of the trap.

It will be understood that the foregoing description of a preferred embodiment of the present invention is for purposes of illustration only, and that the various structural and operational features herein disclosed are susceptible to a number of modifications and changes none of which entails any departure from the spirit and scope of the present invention as defined in the hereto appended claims.

I claim:

1. In a bullet trap for catching and deenergizing a bullet fired along a substantially horizontal path of flight from a firearm, which trap includes a first pair of spaced flat plates located on opposite sides of the path of flight of the bullet and a second pair of spaced flat plates arranged transverse to said first plates on opposite sides of the flight path of the bullet, with said plates defining the respective sides of a passageway having at its front end an entrance opening and at its rear end a throat through which the bullet can pass, and a spent bullet decelerating and energy-dissipating chamber the circumferential boundary wall of which is of generally spiral configuration and the opposite end walls of which are constituted by portions of said second plates, with said passageway communicating with said chamber substantially tangentially of the latter through said throat; the improvement comprising that:

spray nozzle means are provided within said chamber for spraying against said circumferential boundary wall of the latter a liquid lubricating fluid for reducing frictional contact between said circumferential boundary wall and any bullets traveling along the same, and the quantity of said liquid lubricating fluid is sufficient to engulf and flush away any lead dust generated by the travel of said bullets along said circumferential boundary wall as well as spent bullets, fragments thereof, shells and casings.

2. In a bullet trap as claimed in claim 1; the further improvement comprising that said spray nozzle means comprise a conduit for said liquid lubricating fluid, said conduit extending substantially parallel to the axis of said chamber and having a plurality of orifices therein arranged so as to direct said liquid lubricating fluid from said conduit against said circumferential boundary wall of said chamber.

3. In a bullet trap as claimed in claim 1; the further improvement comprising that said lubricating fluid is a white water lubricant.

4. In a bullet trap as claimed in claim 1; the further improvement comprising that a collecting vessel is located under a discharge region of said lower first plate for receiving said liquid lubricating fluid flowing along said lower first plate and any lead dust and any spent bullets, fragments thereof, shells and casings engulfed by and moving with said liquid lubricating fluid.

5. In a bullet trap as claimed in claim 4; the further improvement comprising that said collecting vessel in an upper region thereof includes a substantially horizontal strainer member extending across the entire expanse of said collecting vessel, said strainer member having openings therein which are sufficiently small to permit only lead dust, if any is entrained in said liquid lubricating fluid flowing through said passageway, to pass through said strainer member to the bottom of said collecting vessel and to prevent passage of larger objects such as spent bullets, fragments thereof, shells, jackets, and casings.

6. In a bullet trap as claimed in claim 4; the further improvement comprising that pipe means are provided to establish communication between said collecting vessel and said spray nozzle means, and that pump means are operatively connected with said pipe means for recirculating said liquid lubricating fluid from said collecting vessel to said spray nozzle means.

7. In a bullet trap as claimed in claim 6; the further improvement comprising that said spray nozzle means comprise a conduit for said liquid lubricating fluid, said conduit extending substantially parallel to the axis of said chamber and being connected to said pipe means, and said conduit having a plurality of orifices therein arranged so as to direct said liquid lubricating fluid from said conduit against said circumferential boundary wall of said chamber.

8. In a bullet trap as claimed in claim 6; the further improvement comprising that said pipe means are connected to said collecting vessel in an upper region thereof where said liquid lubricating fluid is clear of any solids.

9. In a bullet trap as claimed in claim 8; the further improvement comprising that said collecting vessel in an upper region thereof above the connecting location of said pipe means includes a substantially horizontal strainer member having openings therein which are sufficiently small to permit only lead dust, if any is entrained in said liquid lubricating fluid flowing through said passageway, to pass through said strainer member to the bottom of said collecting vessel and to prevent passage of larger objects such as spent bullets, fragments thereof, shells, jackets, and casings.

* * * * *